US009412530B2

(12) United States Patent
Kirita

(10) Patent No.: US 9,412,530 B2
(45) **Date of Patent: *Aug. 9, 2016**

(54) SWITCH DEVICE

(71) Applicant: U-SHIN LTD., Tokyo (JP)
(72) Inventor: Toshinori Kirita, Kure (JP)
(73) Assignee: U-SHIN LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/416,494
(22) PCT Filed: Jul. 12, 2013
(86) PCT No.: PCT/JP2013/069194
§ 371 (c)(1),
(2) Date: Jan. 22, 2015
(87) PCT Pub. No.: WO2014/017324
PCT Pub. Date: Jan. 30, 2014

(65) Prior Publication Data

US 2015/0179366 A1 Jun. 25, 2015

(30) Foreign Application Priority Data

Jul. 25, 2012 (JP) ..... 2012-164546

(51) Int. Cl.
*H01H 27/00* (2006.01)
*H01H 13/02* (2006.01)
(Continued)

(52) U.S. Cl.
CPC ..... *H01H 13/023* (2013.01); *F02N 11/0807* (2013.01); *F02N 11/087* (2013.01);
(Continued)

(58) Field of Classification Search
CPC ..... H01H 2231/026; H01H 2300/032; H01H 27/00; H01H 9/0271
USPC ..... 307/10.5, 10.6; 200/52 R
See application file for complete search history.

(56) References Cited

U.S. PATENT DOCUMENTS 6,777,633 B2 * 8/2004 Kondo ..... H01H 25/041 200/310
8,810,363 B2 * 8/2014 Sakamoto ..... B60R 25/04 180/279

(Continued)

FOREIGN PATENT DOCUMENTS

CN 101430985 5/2009
JP 2011-60626 3/2011

(Continued)

OTHER PUBLICATIONS

International Preliminary Report on Patentability issued on Jan. 27, 2015 in International Application No. PCT/JP2013/069194.

(Continued)

*Primary Examiner* — Renee S Lueble
*Assistant Examiner* — Ahmed Saeed
(74) *Attorney, Agent, or Firm* — Wenderoth, Lind & Ponack, L.L.P.

(57) ABSTRACT

A switch device includes a holder (2), an operation knob (3) that has a display and is held in the holder so as to be movable forward and rearward, a ring-like coil antenna (15), a circuit board (7) on which a detection means for detecting the operation of the operation knob is disposed, LEDs (light source) that are disposed on the circuit board and illuminate the display on the operation knob, and a slider (5) that is stored in the holder 2 so as to be movable forward and rearward integrally with the operation knob and has light guide paths for the LEDs, a center axis of the coil antenna is offset from an operational center line of the operation knob, and the light guide paths of the slider and the display on the operation knob are disposed opposed to a center hole of the coil antenna.

8 Claims, 9 Drawing Sheets

(51) Int. Cl.

| | |
|---|---|
| ***F02N 11/08*** | (2006.01) |
| ***H01Q 1/22*** | (2006.01) |
| ***H01Q 1/32*** | (2006.01) |
| ***H01Q 7/00*** | (2006.01) |
| *H01H 13/52* | (2006.01) |
| *H01H 9/16* | (2006.01) |
| *H01H 13/14* | (2006.01) |

(52) U.S. Cl.

CPC ..... *H01Q1/2225* (2013.01); *H01Q 1/32* (2013.01); *H01Q 7/00* (2013.01); *F02N 11/0803* (2013.01); *H01H 9/167* (2013.01); *H01H 13/14* (2013.01); *H01H 13/52* (2013.01); *H01H 2219/014* (2013.01); *H01H 2219/036* (2013.01); *H01H 2219/062* (2013.01)

(56) References Cited

U.S. PATENT DOCUMENTS

| | | | | |
|---|---|---|---|---|
| 9,105,413 | B2 * | 8/2015 | Hiranuma | H01H 9/20 |
| 2004/0206610 | A1 | 10/2004 | Hasegawa et al. | |
| 2009/0115250 | A1 * | 5/2009 | Kim | H01H 27/08 307/10.5 |
| 2010/0206705 | A1 * | 8/2010 | Yamamoto | H01H 13/54 200/341 |
| 2011/0121925 | A1 | 5/2011 | Emmerling et al. | |
| 2012/0075063 | A1 * | 3/2012 | Sakamoto | B60R 25/04 340/5.62 |
| 2012/0140457 | A1 * | 6/2012 | McQuade | H01H 9/04 362/184 |
| 2012/0199461 | A1 * | 8/2012 | Shim | B60R 25/00 200/52 R |
| 2015/0179366 | A1 * | 6/2015 | Kirita | F02N 11/0807 200/314 |

FOREIGN PATENT DOCUMENTS

| | | |
|---|---|---|
| JP | 4705317 | 6/2011 |
| JP | 2011-525455 | 9/2011 |
| JP | 2011-204508 | 10/2011 |
| WO | 2011/102284 | 8/2011 |

OTHER PUBLICATIONS

International Search Report issued Oct. 8, 2013 in International Application No. PCT/JP2013/069194.

* cited by examiner

SWITCH DEVICE

This is a national phase application in the United States of International Patent Application No. PCT/JP2013/069194 with an International filing date of Jul. 12, 2013, which claims priority from Japanese Patent Application No. 2012-164546 filed on Jul. 25, 2012, the disclosures of which are incorporated herein by reference in their entireties.

TECHNICAL FIELD

The present invention relates to a switch device such as an engine start/stop switch mounted on an instrument panel of a vehicle.

BACKGROUND ART

Some recent vehicles are equipped with a smart ignition system that enables engine to start in response to an ID signal wirelessly transmitted from mobile equipment. With the smart ignition system, when the user operates an engine start/stop switch mounted on an in-vehicle instrument panel, a vehicle authentication device transmits a request signal to the mobile equipment. Upon receipt of the request signal, the mobile equipment transmits an own ID signal to the vehicle authentication device. The vehicle authentication device compares an ID code included in the received ID signal with a previously stored ID code, and if both the ID codes match with each other, authenticates the ID code, and enables the engine to start to activate the engine by operating the engine start/stop switch.

Some smart ignition systems have a transponder communication function of communicating with the vehicle authentication device without requiring a power source such as a battery in the mobile equipment, as an auxiliary communication means used when the battery or the like in the mobile equipment becomes exhausted, leading to an uncommunicable state. In the transponder communication function, when the mobile equipment receives starting radio waves transmitted from a coil antenna in the vehicle authentication device, a coil part of a transponder in the mobile equipment generates an electromotive force, and an ID signal is transmitted to the vehicle authentication device by the electromotive force to achieve communication between the vehicle authentication device and the mobile equipment.

The use of the transponder communication function requires the user to operate the engine start/stop switch in the state where the mobile equipment is located near the coil antenna of the vehicle. In order to facilitate the user to recognize the location of the coil antenna, the coil antenna is disposed in the vicinity of the engine start/stop switch.

Regarding the arrangement of the coil antenna, for example, Japanese Patent Publication No. 4705317 proposes that a coil antenna 115 is disposed on the radial outer side of an operation knob 103 of a switch device (engine start/stop switch) 101 as shown in a cutaway side view of FIG. 8. Japanese Unexamined Patent Publication No. 2011-525455 proposes that a coil antenna 215 is disposed along the inner edge of an operation knob 203 as shown in a side sectional view of FIG. 9.

SUMMARY OF THE INVENTION

Problems to be Solved by the Invention

In the configuration proposed in Patent Document 1 as shown in FIG. 8, however, because the coil antenna 115 is disposed on the radial outer side of the operation knob 103, the outer dimension of the switch device 101 disadvantageously becomes large.

In the configuration proposed in Patent Document 2 as shown in FIG. 9, because the coil antenna 215 is disposed along the inner edge of the operation knob 203, the coil antenna 215 is an obstacle in illumination for a display on the operation knob 20 and thus, the display needs to be disposed at the center of the operation knob 203, limiting the degree of flexibility in design.

In consideration of the above-mentioned problems, and object of the present invention is to provide a switch device capable of ensuring a high degree of flexibility in illumination for a display on an operation knob while achieving size reduction.

Means for Solving the Problems

To attain the object, according to a first aspect of the present invention, a switch device includes:

a holder;

an operation knob with a display, the operation knob held in the holder so as to be movable forward and rearward;

a ring-like coil antenna that transmits starting radio waves for activating external mobile equipment;

a circuit board on which a wire for connecting the coil antenna to an external electric circuit and a detection means for detecting the operation of the operation knob are disposed;

a light source disposed on the circuit board, the light source illuminating the display on the operation knob; and a slider stored in the holder so as to be movable forward and rearward integrally with the operation knob, the slider having a light guide path for the light source, wherein a center axis of the coil antenna is offset from an operational center line of the operation knob, and the light guide path of the slider and the display on the operation knob are disposed opposed to a center hole of the coil antenna.

According to a second aspect of the present invention, in the first aspect of the present invention, the coil antenna is fixed to the holder.

According to a third aspect of the present invention, in the first aspect of the present invention, the coil antenna is fixed to a back face of the operation knob.

According to a fourth aspect of the present invention, in any of the first to third aspects of the present invention, the slider has a through hole that allows forward and rearward movement of the slider, and receives part of the coil antenna.

According to a fifth aspect of the present invention, in any of the first to fourth aspects of the present invention, the coil antenna is elliptical.

According to a sixth aspect of the present invention, in any of the first to fourth aspects of the present invention, the coil antenna is semicircular.

According to a seventh aspect of the present invention, in any of the first to fourth aspects of the present invention, the coil antenna is flat.

According to an eighth aspect of the present invention, in any of the first to seventh aspects of the present invention, one half of the outer periphery of the coil antenna divided in the radial direction of the coil antenna is located on the outer side of the outer periphery of the operation knob, and the other half of the outer periphery of the coil antenna is located on the inner side of the outer periphery of the operation knob.

Effect of the Invention

According to the first aspect of the invention, because the center axis of the coil antenna is offset from the operational center line of the operation knob, and the light guide path of the slider and the display on the operation knob are disposed opposed to the center hole of the coil antenna, the coil antenna does not block light from the light source even when the outer diameter of the coil antenna is made small, and a high degree of flexibility in illumination for the display on the operation knob can be ensured while making the switch device compact.

According to the second aspect of the invention, because the coil antenna is fixed to the holder, the coil antenna can be electrically connected to the circuit board for certain irrespective of forward and rearward movement of the operation knob and the slider.

According to the third aspect of the invention, because the coil antenna is fixed to the back face of the operation knob in the vicinity of the mobile equipment held by the user, the capability of communication between the coil antenna and the mobile equipment is improved.

According to the fourth aspect of the invention, in order to prevent interference of the slider with the coil antenna and allow forward and rearward movement of the slider, part of the coil antenna is located in the through hole in the slider. Thus, the through hole as a dead space can be effectively used to receive part of the coil antenna, achieving size reduction of the switch device.

According to the fifth to seventh aspects of the invention, by varying the shape of the coil antenna depending on illumination, a high degree of flexibility in illumination can be ensured without lowering the communication capability of the coil antenna.

According to the eighth aspect of the invention, by offsetting the coil antenna such that one half of the outer periphery of the coil antenna divided in the radial direction, which requires a predetermined space, is located on the outer side of the outer periphery of the operation knob, a high degree of flexibility in illumination for the display on the operation knob can be ensured without increasing the outer diameter of the coil antenna.

BRIEF DESCRIPTION OF THE DRAWINGS

The foregoing and other features of the present invention will become apparent from the following description and drawings of an illustrative embodiment of the invention in which.

MODE FOR CARRYING OUT THE INVENTION

Embodiments of the present invention will be described below with reference to appended drawings.

Figure 1:
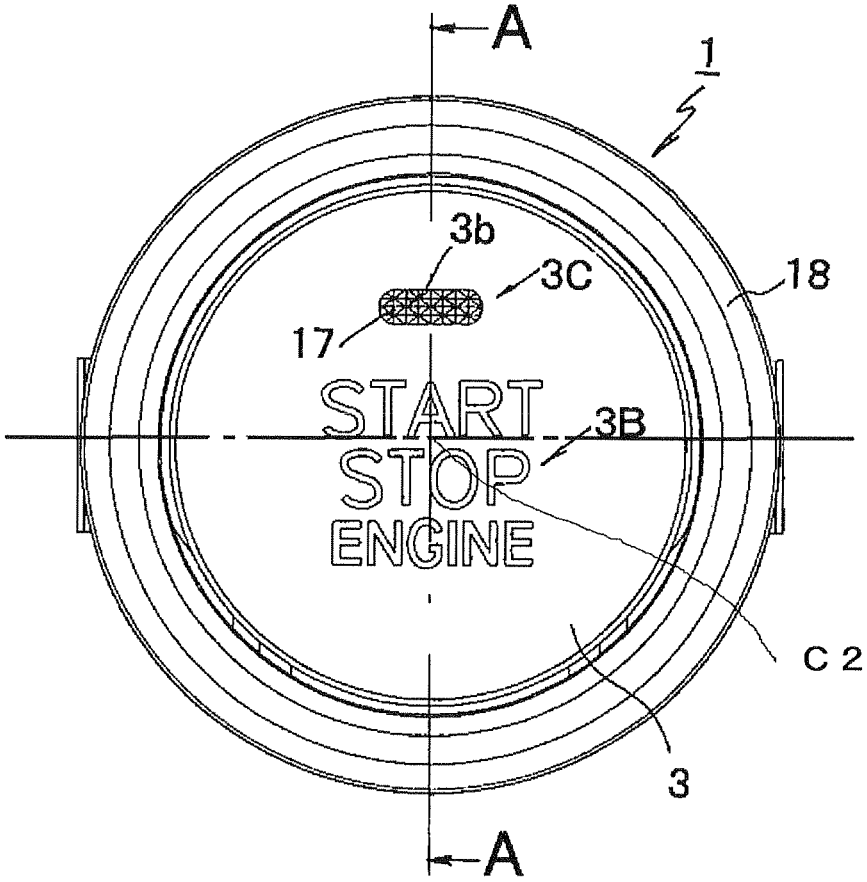
FIG. 1 is a front view illustrating a switch device according to the present invention.
Figure 2:
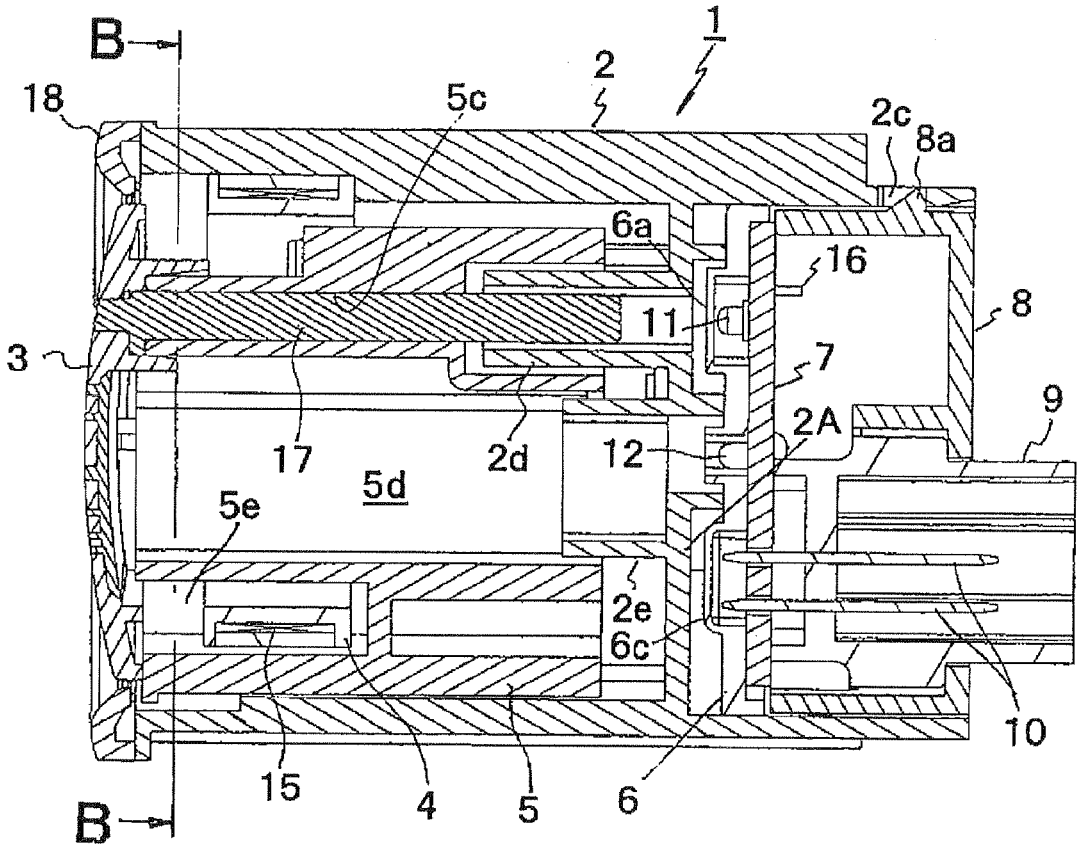
FIG. 2 is a sectional view taken along a line A-A in FIG. 1.
Figure 3:
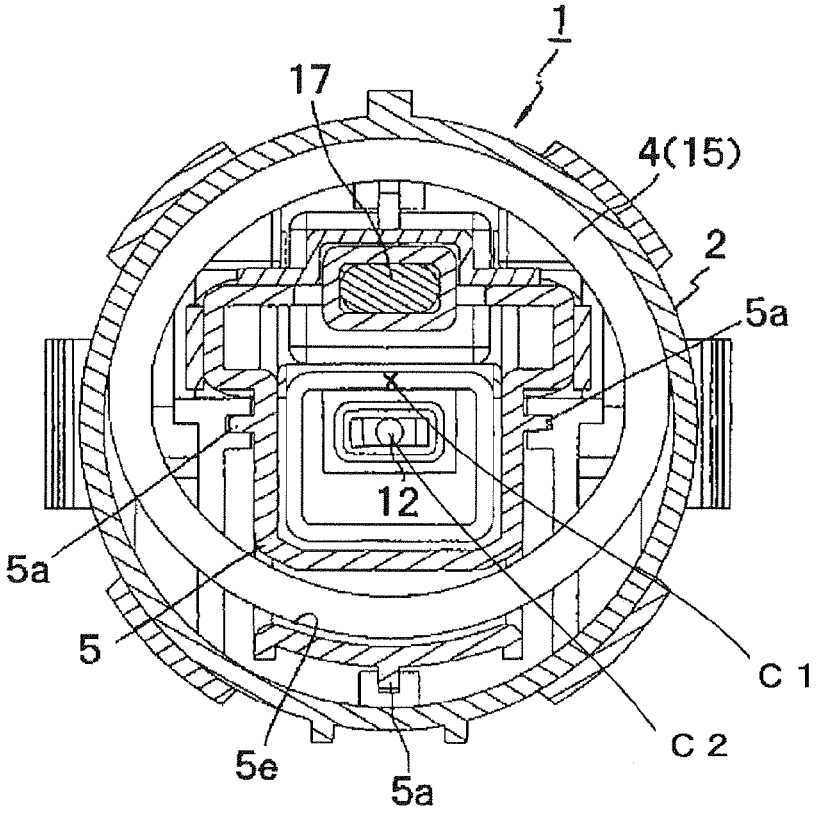
FIG. 3 is a sectional view taken along a line B-B in FIG. 2.
Figure 4:
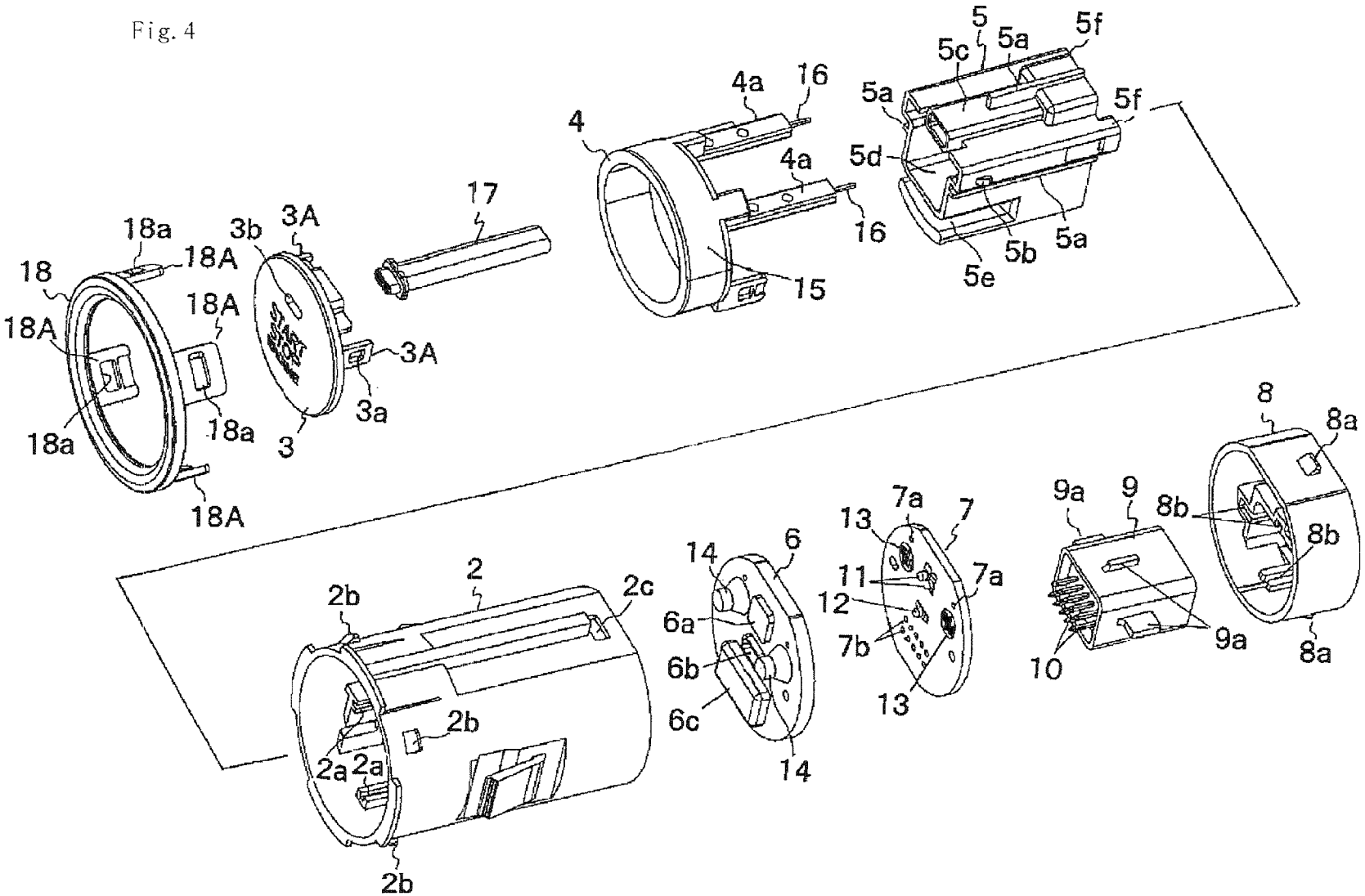
FIG. 4 is an exploded perspective view illustrating the switch device according to the present invention.

FIG. 1 is a front view illustrating a switch device according to the present invention, FIG. 2 is a sectional view taken along a line A-A in FIG. 1, FIG. 3 is a sectional view taken along a line B-B in FIG. 2, and FIG. 4 is an exploded perspective view illustrating the switch device.

The switch device 1 in accordance with this embodiment is an engine start/stop switch mounted on an instrument panel of a vehicle equipped with a smart ignition system. As shown in FIG. 2, an operation knob 3, an antenna holder 4, a slider 5, a rubber contact 6, and a circuit board 7 are incorporated into a substantially cylindrical holder 2. The holder 2, the operation knob 3, the antenna holder 4, the slider 5, and the circuit board 7 each are integrally molded using a non-conductive resin, and the rubber contact 6 is integrally molded using non-conductive rubber. In following description, the left side in FIG. 2 is defined as a front side, and the right side in FIG. 2 is defined as the rear side.

As shown in FIG. 4, guide grooves 2*a* are formed in the longitudinal direction (forward and rearward direction) at three places on the lower, left, and right sides of the inner periphery of the holder 2 (only the two grooves are shown in FIG. 4). Engagement protrusions 2*b* are formed at four places on the outer periphery of a front end of the holder 2 (only the three protrusions are shown in FIG. 4). Rectangular engagement holes 2*c* are formed on the upper and lower sides of a rear end of the holder 2 (only one (upper) hole is shown in FIG. 4).

As shown in FIG. 2, a cylindrical closed-end cover 8 is attached to an opening at the rear end of the holder 2. A prismatic closed-end connector 9 is inserted and held under the cover 8. As shown in FIG. 4, engagement protrusions 8*a* are formed on respective upper and lower flat faces of the cover 8. Guide grooves 8*b* are formed in the forward and rearward direction at four places on the upper, lower, left, and right sides of the inner periphery of the cover 8 (only the three grooves are shown in FIG. 4). Long guide rails 9*a* are formed in the forward and rearward direction at four places on the upper, lower, left, and right sides of the outer periphery of the connector 9 (only the three rails are shown in FIG. 4).

In the state where the connector 9 is inserted and held in the cover 8, the guide rails 9*a* vertically provided at the four places of the outer periphery of the connector 9 are fitted into the respective guide grooves 8*b* formed at the four places of the inner periphery of the cover 8. In the state where the cover 8 is attached to the holder 2 and covers the opening at the rear end of the holder 2, the cover 8 is fitted in the inner periphery of the rear end of the holder 2, and the protruding engagement protrusions 8*a* on the upper and lower sides of the cover 8 are engaged with the respective engagement holes 2*c* on the upper and lower sides of the rear end of the holder 2.

In this embodiment, the cover 8 and the connector 9 are integrally molded using a non-conductive resin. Ten metal connection terminals 10 arranged in five columns in the horizontal direction and two upper and lower rows are horizontally inserted and held in the connector 9.

As shown in FIG. 2, a partition 2A is formed near the rear end of the holder 2. The rubber contact 6 and the circuit board 7, which are bonded to each other, are stored between the partition 2A and the cover 8.

As shown in FIG. 4, the circuit board 7 has a substantially disc-like shape. Two LEDs 11 as light sources are arranged side-by-side in the upper position in the widthwise center of the front face of the circuit board 7. One LED 12 as a light source is disposed below the LEDs 11. An insertion hole 7*a* and a fixed contact 13 are disposed on each of the left and right sides of the LEDs 11, and the insertion hole is located above the fixed contact. Ten insertion holes 7*b* are formed in the lower position in the widthwise center of the circuit board 7. The ten connection terminals 10 in the connector 9 are inserted into the respective insertion holes 7*b* (See FIG. 2).

A thin translucent part 6*a* that is rectangular in a plan view is formed in the upper position in the widthwise center of the rubber contact 6 (position opposed to the LEDs 11 on the circuit board 7). A laterally-extending rectangular opened window 6*b* is formed below the rubber contact 6 (position opposed to the LED 12 on the circuit board 7). Switch parts 14 as detection means are formed on the left and right sides of the translucent part 6*a* of the rubber contact 6 (positions corresponding to the fixed contacts 13 on the circuit board 7). A rectangular bag-like convex part 6*c* is protrudingly provided below the opened window 6*b* of the rubber contact 6. In order to prevent interference between the rubber contact 6 and the ten connection terminals 10 in the connector 9, the convex part 6*c* is expanded to form a recess on the opposite face of the rubber contact 6. The left and right switch parts 14 on the rubber contact 6 each are dome-shaped. A movable contact not shown is provided in each of the switch parts 14. When the switch parts 14 are pressed to close the movable contacts not shown and the fixed contacts 13 on the circuit board 7, the contacts are brought into conduction, turning on the switch parts 14.

As shown in FIG. 2, prismatic light guide pipes 2*d* and 2*e* are integrally formed to extend toward the front (left in FIG. 2) at the upper and lower positions of the partition 2A, respectively, which are opposed to the LEDs 11 and 12 in the vicinity of the rear end of the holder 2. The light guide pipes 2*d* and 2*e* partially constitute light guide paths for illumination light emitted forward from the LEDs 11 and 12.

The slider 5 is a member stored in the holder 2 so as to be movable forward and rearward. Guide rails 5*a* are integrally formed in the longitudinal direction (forward and rearward direction) at three places on the left, right, and lower sides of the outer periphery of the slider 5 (See FIG. 3). Engagement protrusions 5*b* are integrally formed at three places on the left, right, and lower sides of the outer periphery of the front end of the slider 5 (only one protrusion is shown in FIG. 4).

As shown in FIG. 4, a prismatic lens storage part 5*c* is integrally formed in the forward and rearward direction at the widthwise center of the upper face of the slider 5. A prismatic light guide 5*d* is formed in the lower portion of the slider 5. A through hole 5*e* opened to the front, left, and right sides are formed in the front lower portion of the holder 5. Block-like switch operation parts 5*f* are integrally formed to extend rearward on the left and right sides of the upper portion of the rear end of the slider 5. The switch operation parts 5*f* are in contact with the left and right switch parts 14 on the rubber contact 6. The light guide 5*d* of the slider 5 and the opened light guide pipe 2*e* of the holder 2 constitute a light guide path for guiding light from the LED 12 to the forward operation knob 3.

As shown in FIG. 2, a ring-like coil antenna 15 is fixed to the holder 2 via the antenna holder 4. The coil antenna 15 is formed by winding an antenna wire around a groove in the outer periphery of the ring-like antenna holder 4, and transmits starting radio waves for activating the external mobile equipment held by the driver. As shown in FIG. 4, one ends of metal connection terminals 16 are provided in two respective protruding parts 4*a* horizontally extending rearward from the left and right sides of the upper portion of the antenna holder 4, and are connected to respective ends of the coil wire. The other ends (front ends) of the connection terminals 16 are inserted into the respective left and right insertion holes 7*a* formed on the upper portion of the circuit board 7, and are electrically connected to the circuit board 7. That is, the coil antenna 15 is electrically connected to the circuit board 7 via the two left and right connection terminals 16.

In this embodiment, as shown in FIG. 3, the coil antenna 15 and the antenna holder 4 holding the coil antenna are elliptical. A center (gravity center) axis C1 of the antenna holder 4 and the coil antenna 15 is offset from an operational center line C2 of the operation knob 3 (See FIG. 1) upward in the vertical direction, and the antenna holder 4 and the coil antenna 15 are partially located in the through hole 5*e* in the slider 5. Describing in more detail, one half (upper side in FIG. 3) of the outer periphery of the coil antenna 15 divided in the radial direction of the coil antenna 15 is located on the outer side of the outer periphery of the operation knob 3, and the other half (lower side in FIG. 3) of the outer periphery of the coil antenna 15 is located on the inner side of the outer periphery of the operation knob 3. By partially locating the coil antenna 15 and the antenna holder 4 in the through hole 5*e* in the slider 5, the slider 5 can move forward and rearward.

The disc-like operation knob 3 is fixed to the front end of the slider 5, and the operation knob 3 and the slider 5 integrally slide forward and rearward in the holder 2. As shown in FIG. 4, engagement pieces 3A horizontally extend rearward from three places of the outer periphery of the operation knob 3 (only the two engagement pieces are shown in FIG. 4). The engagement pieces 3A have respective rectangular engagement holes 3*a*. As shown in FIG. 1, a character display part 3B with "START STOP ENGINE" and an indicator display part 3C that is to be illuminated are formed on the face of the operation knob 3. A long hole-like horizontally-extending opened window 3*b* is formed in the indicator display part 3C.

The operation knob 3 is assembled to the outer periphery of the front end of the slider 5 by fitting the engagement pieces 3A of the operation knob 3 into the outer periphery of the front end of the slider 5, and engaging the three engagement protrusions 5*b* protruding from the outer periphery of the front end of the slider 5 with the three engagement holes 3*a* in the engagement pieces 3A. By fitting the slider 5 into the holder 2 from the front in the state where the three guide rails 5*a* on the outer periphery of the slider 5 are aligned with the three guide grooves 2*a* in the inner periphery of the holder 2, the operation knob 3 and the slider 5 thus assembled are held to be movable along the guide grooves 2*a* of the holder 2 in the forward and rearward direction.

An oblong light-guide indicator lens 17 is fitted into the lens storage part 5*c* of the slider 5. As shown in FIG. 2, the front end of the indicator lens 17 is fitted into the opened window 3*b* in the operation knob 3, and along with the operation knob 3, is exposed to the vehicle compartment. The rear end of the indicator lens 17 is inserted into the light guide pipe 2*d* formed on the partition 2A of the holder 2. The indicator lens 17 and the light guide pipe 2*d* constitute a light guide path for guiding light from the LED 11 to the operation knob 3 ahead of the LED.

In this embodiment, the light guide paths formed in the slider 5 to guide light from the LEDs 11 and 12 to the operation knob 3 ahead of the LEDs, and the character display part 3B and the indicator display part 3C of the operation knob 3 are disposed opposed to the elliptical center hole of the coil antenna 15 and the antenna holder 4.

After the operation knob 3 is fitted into the slider 5 and stored in the holder 2 as described above, a resin bezel 18 molded into a ring is fitted into the outer periphery of the front end of the holder 2. Four engagement pieces 18A are formed integrally with the bezel 18 on the upper, lower, left, and right sides of the bezel 18 to extend rearward. The engagement pieces 18A have respective rectangular engagement holes 18*a*. The bezel 18 is fixed to the outer periphery of the front end of the holder 2 by fitting the engagement pieces 18A into the outer periphery of the holder 2 from the front and engaging the four engagement protrusions 2*b* formed on the outer periphery of the holder 2 with the engagement holes 18*a* in the engagement pieces 18A.

Next, the action of the switch device 1 having such a configuration will be described.

While the driver does not operate the operation knob 3, the switch device 1 is in a non-operating state. In the non-operating state, the pair of left and right switch operation parts 5*f*, which horizontally protrude from the rear end of the slider 5 that slides integrally with the operation knob 3, do not press the switch parts 14 on the rubber contact 6. This leads to the non-conductive state where the movable contacts of the switch parts 14 are not in contact with the fixed contacts 13 on the circuit board 7, turning off the switch parts 14.

When the operation knob 3 is pushed in the OFF state of the switch parts 14, the slider 5 slides rearward together with the operation knob 3. Then, the pair of left and right switch operation parts 5*f* on the slider 5 push the switch parts 14 on the rubber contact 6. Consequently, the movable contacts on the switch parts 14 contact with the fixed contacts 13 on the circuit board 7 to bring the contacts into conduction, such that the two switch parts 14 are simultaneously turned on. When the operation knob 3 is pressed to turn on/off the switch parts 14, the LED 11 on the circuit board 7 emits light. This light passes through the light guide pipe 2*d* of the holder 2 and the indicator lens 17, and is emitted through the opened window 3*b* of the operation knob 3 to illuminate the indicator display part 3C. For example, at night, the LED 12 on the circuit board 7 is activated, and illumination light emitted from the LED 12 passes through the light guide path constituted of the light guide pipe 2*e* of the holder 2 and the light guide 5*d* of the slider 5, and reaches the operation knob 3 to illuminate the character display part 3B of the operation knob 3.

When the two switch parts 14 on the circuit board 7 are simultaneously turned on during stop of the engine, the vehicle authentication device transmits a request signal from an antenna part (not shown) of a transceiver disposed in the vehicle compartment to the vehicle compartment. The mobile equipment (not shown) receives the request signal at a transceiver part, and transmits an ID signal to the vehicle authentication device.

Next, the vehicle authentication device compares an ID code included in the ID signal received from the coil antenna 15 with a previously stored ID code. If the ID codes matches with each other, the ID code is authenticated, and the engine not in operation is stated, or the engine in operation is stopped.

Then, when the user moves his/her hand off the operation knob 3 of the switch device 1, the operation knob 3 is returned to an original non-operating position shown in FIG. 2 by the elastic restoring force of the switch parts 14 of the rubber contact 6. Thus, the switch operation parts 5*f* on the operation knob 3 are separated from the switch parts 14, turning off the switch parts 14.

As described above, in the switch device 1 in accordance with this embodiment, the center (gravity center) axis C1 of the coil antenna 15 is offset from the operational center line C2 of the operation knob 3 in the vertical upward direction, and the light guide paths of the slider 5 and the character display part 3D and the indicator display part 3C of the operation knob 3 are disposed opposed to the center hole of the coil antenna 15. Therefore, the coil antenna 14 does not block light from the LEDs 11 and 12 even when the outer diameter of the coil antenna 15 is made small. This can ensure a high degree of flexibility in illumination for the character display part 3B and the indicator display part 3C of the operation knob 3 while making the switch device 1 compact.

Especially, in this embodiment, the coil antenna 15 is offset such that one half (upper side in FIG. 3) of the outer periphery of the coil antenna 15 divided in the radial direction, which requires a predetermined space, is located on the outer side of the outer periphery of the operation knob 3. This can ensure a high degree of flexibility in illumination for the character display part 3B and the indicator display part 3C of the operation knob 3 without increasing the outer diameter of the coil antenna 15.

Because the coil antenna 15 is fixed to the holder 2 via the antenna holder 4 in this embodiment, the coil antenna 15 can be electrically connected to the circuit board 7 for certain irrespective of forward and rearward movement of the operation knob 3 and the slider 5.

Furthermore, in this embodiment, in order to prevent interference of the slider 5 with the coil antenna 15 and the antenna holder 4 to allow forward and rearward movement of the slider 5, the coil antenna 15 and the antenna holder 4 are partially located in the through hole 5*e* in the slider 5. This enables the use of the through hole 5*e* as a dead space, making the switch device 1 compact.

Although the center (gravity center) axis C1 of the coil antenna 15 is offset from the operational center line C2 of the operation knob 3 in the vertical upward direction in the embodiment, the coil antenna 15 may be offset downward, or to left or right. For example, offsetting the center (gravity center) axis C1 of the coil antenna 15 from the operational center line C2 of the operation knob 3 in the vertical downward direction can improve the capability of communication between the coil antenna 15 and the mobile equipment in the case where the switch device 1 is provided in the upper portion of the instrument panel, or the user operates the operation knob 3 while holding a card-type mobile equipment.

Figure 5:
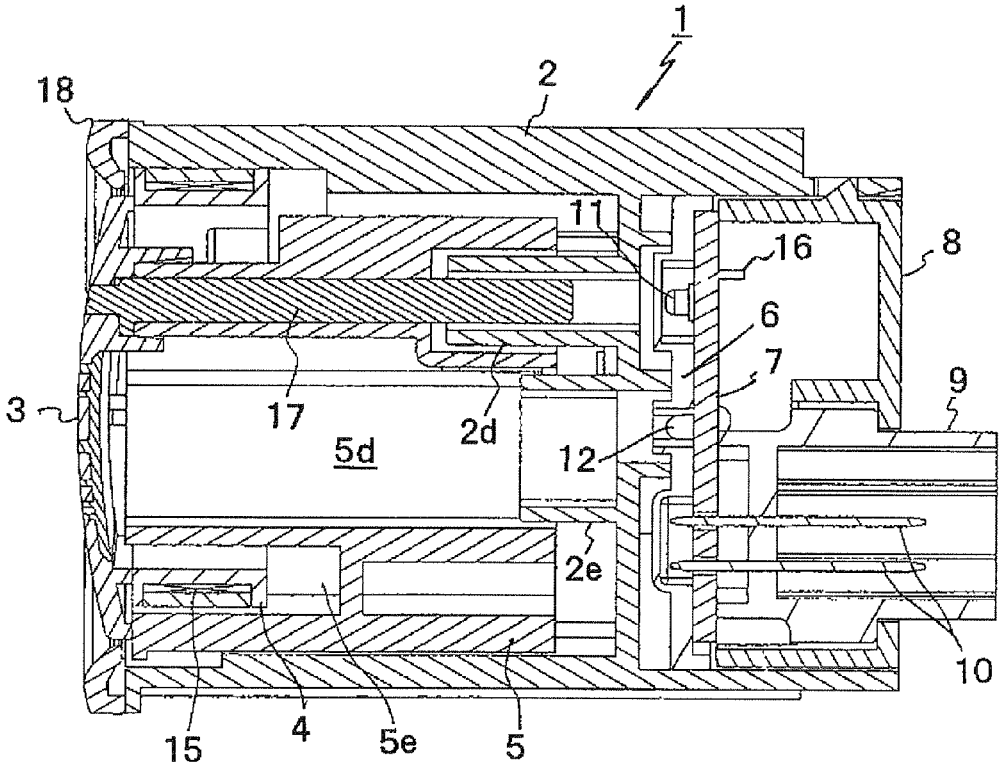
FIG. 5 is a side sectional view illustrating a switch device in accordance with another embodiment of the present invention.

Although the coil antenna 15 is fixed to the holder 2 via the antenna holder 4 in the embodiment, as shown in the side sectional view of FIG. 5, the coil antenna 15 may be fixed to the back face of the operation knob 3 via the antenna holder 4. As a result, the coil antenna 15 is located at the back face of the operation knob 3 in the vicinity of the mobile equipment held by the user, improving the capability of communication between the coil antenna 15 and the mobile equipment. The same components in FIG. 5 as those in FIG. 2 are given the same reference numerals.

Figure 6:
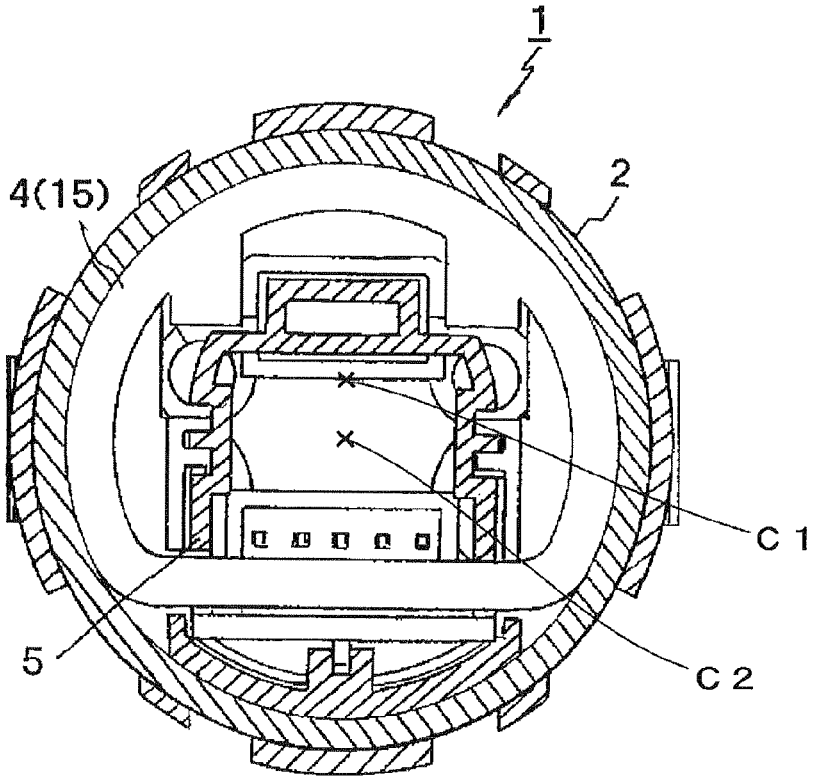
FIG. 6 is a front sectional view illustrating a coil antenna of another shape of the switch device according to the present invention.
Figure 7:
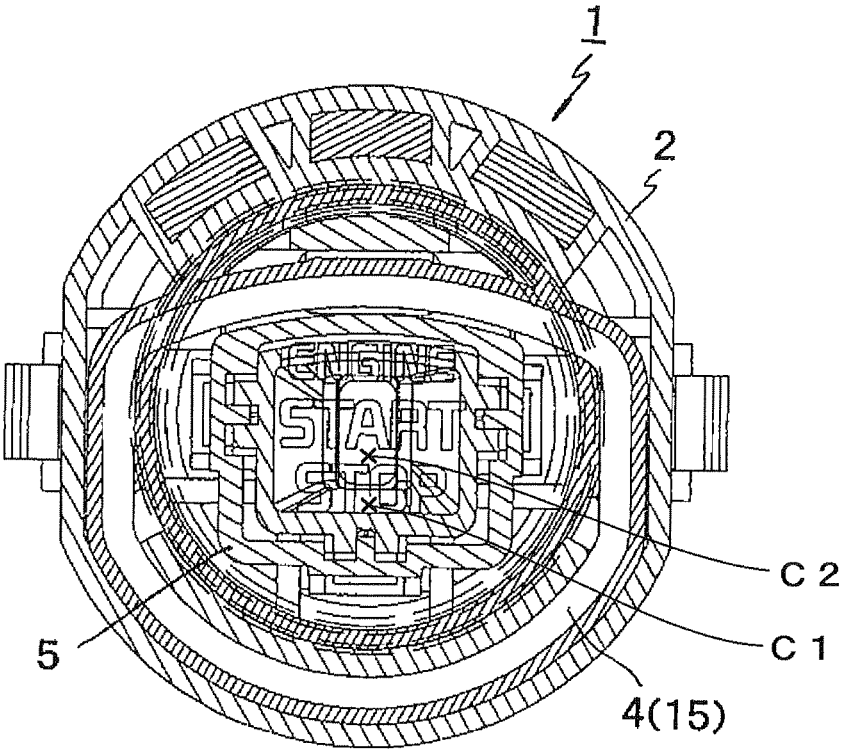
FIG. 7 is a front sectional view illustrating a coil antenna of still another shape of the switch device according to the present invention.
Figure 8:
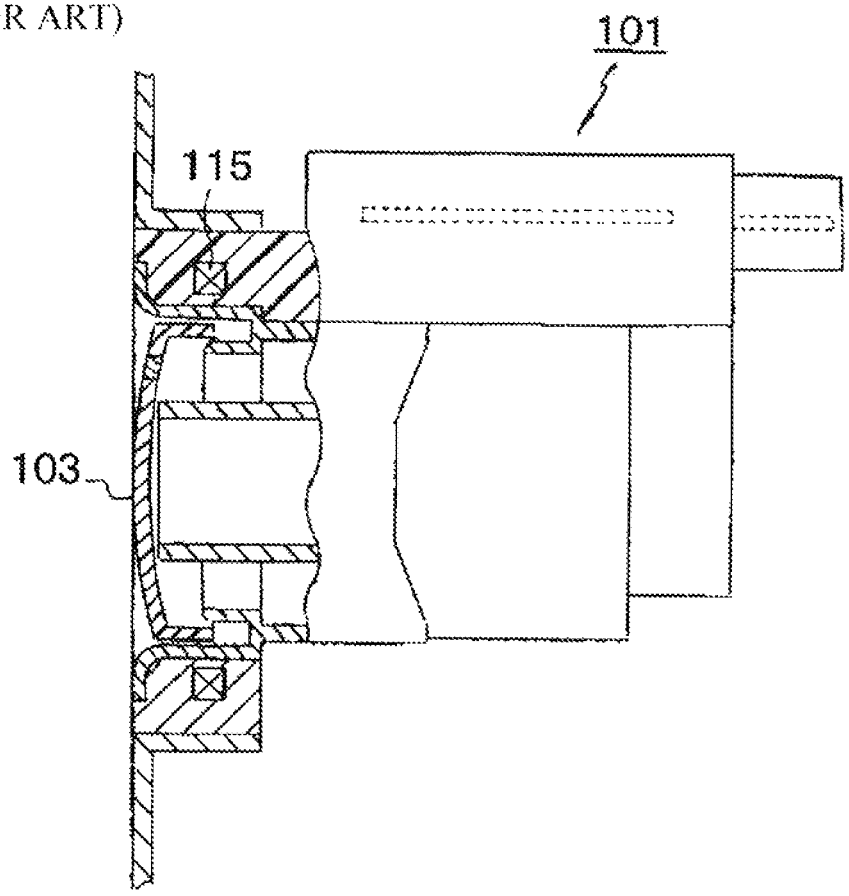
Fig. 8 (PRIOR ART)
FIG. 8 is a cutaway side view illustrating a switch device proposed in Japanese Patent Publication No. 4705317.
Figure 9:
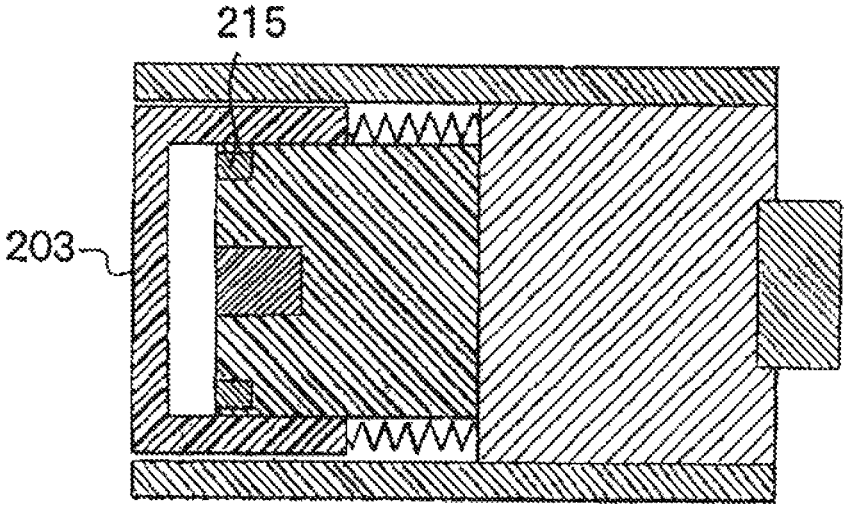
Fig. 9 (PRIOR ART)
FIG. 9 is a side sectional view illustrating a switch device proposed in Japanese Unexamined Patent Publication No. 2011-525455.

Although the coil antenna 15 and the antenna holder 4 holding the coil antenna are elliptical in the embodiment, they may have another shape. For example, as shown in FIG. 6, the coil antenna 15 and the antenna holder 4 may be semicircular. Alternatively, as shown in FIG. 7, the coil antenna 15 and the antenna holder 4 may be flat, or completely rounded though not shown. Also in these embodiments, the center (gravity center) axis C1 of the coil antenna 15 may be offset with respect to the operational center line C2 of the operation knob 3. Such configurations can also achieve the same effect.

The present invention applies to the switch device as the engine start/stop switch in the above description. As a matter of course, however, the present invention can also apply to any other switch devices having similar configurations.

DESCRIPTION OF SYMBOLS

1 Switch device
2 Holder
2A Partition of holder
2*a* Guide groove of holder
2*b* Engagement protrusion of holder
2*c* Engagement hole of holder
2*d*, 2*e* Light guide pipe of holder
3 Operation knob
3A Engagement piece of operation knob
3B Character display part of operation knob

3C Indicator display part of operation knob
3*a* Engagement hole of operation knob
3*b* Opened window of operation knob
4 Antenna holder
4*a* Protruding part of antenna holder
5 Slider
5*a* Guide rail of slider
5*b* Engagement protrusion of slider
5*c* Lens storage part of slider
5*d* Light guide of slider
5*e* Through hole of slider
5*f* Switch operation part of slider
6 Rubber contact
6*a* Translucent part of rubber contact
6*b* Opened window of rubber contact
6*c* Convex part of rubber contact
7 Circuit board
7*a*, 7*b* Insertion hole of circuit board
8 Cover
8*a* Engagement protrusion of cover
8*b* Guide groove of cover
9 Connector
9*a* Guide rail of connector
10 Connection terminal
11, 12 LED (light source)
13 Fixed contact
14 Switch part (detection means)
15 Coil antenna
16 Connection terminal
17 Indicator lens
18 Bezel
18A Engagement piece of bezel
18*a* Engagement hole of bezel

The invention claimed is:

1. A switch device comprising:

a holder;

an operation knob with a display, the operation knob held in the holder so as to be movable forward and rearward;

a ring-like coil antenna that transmits starting radio waves for activating external mobile equipment;

a circuit board on which a wire for connecting the coil antenna to an external electric circuit and a detection means for detecting the operation of the operation knob are disposed;

a light source disposed on the circuit board, the light source illuminating the display on the operation knob; and a slider stored in the holder so as to be movable forward and rearward integrally with the operation knob, the slider having a light guide path for the light source, wherein a center axis of the coil antenna is offset from an operational center line of the operation knob, and the light guide path of the slider and the display on the operation knob are disposed opposed to a center hole of the coil antenna.

2. The switch device according to claim 1, wherein the coil antenna is fixed to the holder.

3. The switch device according to claim 1, wherein the coil antenna is fixed to a back face of the operation knob.

4. The switch device according to claim 1, wherein the slider has a through hole that allows forward and rearward movement of the slider, and receives part of the coil antenna.

5. The switch device according to claim 1, wherein the coil antenna is elliptical.

6. The switch device according to claim 1, wherein the coil antenna is semicircular.

7. The switch device according to claim 1, wherein the coil antenna is flat.

8. The switch device according to claim 1, wherein one half of the outer periphery of the coil antenna divided in the radial direction of the coil antenna is located on the outer side of the outer periphery of the operation knob, and the other half of the outer periphery of the coil antenna is located on the inner side of the outer periphery of the operation knob.

* * * * *